US012643728B2

(12) United States Patent
Cho et al.

(10) Patent No.: US 12,643,728 B2
(45) Date of Patent: Jun. 2, 2026

(54) DISPLAY DEVICE PACKAGING ASSEMBLY

(71) Applicant: Samsung Display Co., LTD., Yongin-si (KR)

(72) Inventors: Jin-Wook Cho, Yongin-si (KR); Su-Young Yun, Yongin-si (KR); Ja Huem Koo, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 18/808,318

(22) Filed: Aug. 19, 2024

(65) Prior Publication Data

US 2025/0153919 A1 May 15, 2025

(51) Int. Cl.
*B65D 81/133* (2006.01)
*B65D 1/34* (2006.01)
*B65D 85/68* (2006.01)

(52) U.S. Cl.
CPC ..... *B65D 81/133* (2013.01); *B65D 1/34* (2013.01); *B65D 85/68* (2013.01); *B65D 2585/6837* (2013.01)

(58) Field of Classification Search
CPC . B65D 1/34; B65D 1/36; B65D 21/02; B65D 21/0202; B65D 25/10; B65D 71/70; B65D 81/025; B65D 81/054; B65D 81/113; B65D 81/127; B65D 81/133; B65D 85/30; B65D 85/48; B65D 85/62; B65D 85/64; B65D 85/68; B65D 85/86; B65D 2585/6835; B65D 2585/6837
USPC ..... 206/521, 523, 557, 564
See application file for complete search history.

(56) References Cited

U.S. PATENT DOCUMENTS 2,661,835 A * 12/1953 Grishaber ..... B65D 85/544 206/424
3,732,976 A * 5/1973 Bessett ..... B65D 77/0433 206/521.1
3,804,239 A * 4/1974 O'Brien ..... B65D 1/34 206/523
2021/0176351 A1 6/2021 Bulkley et al.

FOREIGN PATENT DOCUMENTS

EP 0502813 A1 * 9/1992 ..... B65D 81/1075
JP 2008174272 A 7/2008
KR 1020130079033 A 7/2013
KR 1020140142421 A 12/2014
KR 1020150005280 A 1/2015
KR 1020220051886 A 4/2022
WO WO-2022248010 A1 * 12/2022 ..... B65D 81/113

* cited by examiner

*Primary Examiner* — Bryon P Gehman
(74) *Attorney, Agent, or Firm* — CANTOR COLBURN LLP

(57) ABSTRACT

A display device packaging assembly includes: a packaging tray including a wall defining an accommodating space, and cushion pads disposed between and on display devices loaded in the accommodating space. Each of the cushion pads includes a body and a first wing disposed on one side of said body, and the first wing includes a first sub-wing, a second sub-wing, and a third sub-wing disposed between the first sub-wing and the second sub-wing. In a first direction, a width of the third sub-wing is smaller than each of a width of the first sub-wing and a width of the second sub-wing.

18 Claims, 12 Drawing Sheets

DISPLAY DEVICE PACKAGING ASSEMBLY

This application claims priority to Korean Patent Application No. 10-2023-0158346, filed on Nov. 15, 2023, and all the benefits accruing therefrom under 35 U.S.C. § 119, the content of which in its entirety is herein incorporated by reference.

BACKGROUND

(a) Technical Field

This disclosure relates to a display device packaging assembly, and more specifically to a packaging assembly that can be used to load and transport display devices.

(b) Description of the Related Art

Display devices such as light emitting displays and liquid crystal displays are used to display images in electronic devices or electronic products such as monitors, televisions, tablets, laptop computers, mobile phones, etc. The display device can be loaded into a packaging tray or box and transported to a set company or assembly line, and it can be assembled with other parts at the set company or assembly line and manufactured into an electronic device or product that is sold to the general consumer.

SUMMARY

During the process of being loaded into a packaging tray and transported, the display devices may move within the packaging box due to vibration or impact, and as a result, the display devices may be damaged.

Embodiments provide a display device packaging assembly that can prevent damage to display devices.

A display device packaging assembly according to an embodiment includes: a packaging tray including a wall defining an accommodating space, and cushion pads disposed between and on display devices loaded in the accommodating space. Each of the cushion pads includes a body and a first wing disposed on one side of the body, and the first wing includes a first sub-wing, a second sub-wing, and a third sub-wing disposed between the first sub-wing and the second sub-wing. In a first direction, a width of the third sub-wing in the first direction is smaller than each of a width of the first sub-wing and a width of the second sub-wing.

A length of the second sub-wing may be smaller than a length of the first sub-wing in a second direction intersecting the first direction.

The third sub-wing may be aligned with a central axis of the body extending in the first direction.

The wall may include a first side wall and a second side wall facing each other in the first direction, and the first side wall may include a first protrusion, a second protrusion, and a third protrusion, and the third protrusion which protrude toward the accommodation space and are aligned in a second direction intersecting the first direction. The second protrusion may be disposed between the first sub-wing and the second sub-wing and may face the third sub-wing in the first direction.

The first sub-wing may be disposed between the first protrusion and the second protrusion, and the second sub-wing may be disposed between the second protrusion and the third protrusion.

The first sub-wing may be spaced apart from an end of the body in a second direction intersecting the first direction and near the first sub-wing, and the second sub-wing may be spaced apart from another end of the body in the second direction and near the second sub-wing.

Each of the cushion pads may further include a second wing that is symmetrical to the first wing with respect to the body.

Each of the display devices may include a display panel and a printed circuit board connected to the display panel. The body may overlap the display panel in a plan view. Each of the cushion pads may further include a third wing overlapping the printed circuit board in the plan view.

The first wing and the second wing may extend from the body in the first direction, and the third wing may extend from the body in a second direction intersecting the first direction.

The display device packaging assembly may be provided in plurality, and a bottom of each of the packaging trays may include a protruding protrusion that protrudes downward such that the package tray of an upper display device packaging assembly among the plurality of display device packaging assemblies may press against the cushion pads in the accommodation space of a lower display device packaging system among the plurality of display device packaging assemblies.

Sides of each of the cushion pads opposite to each other may be adhesive.

A display device packaging assembly according to an embodiment includes: a packaging tray including a wall defining an accommodating space, display devices loaded in the accommodating space, and cushion pads at least some of which are disposed between at least the display devices. Each of the cushion pads includes a body and a first wing extending from the body in a first direction. The first wing includes a first sub-wing, a second sub-wing, and a third sub-wing disposed between the first sub-wing and the second sub-wing in a second direction intersecting the first direction. A length of the first sub-wing and a length of the second sub-wing in the second direction are different from each other. Each of the display devices may include a display panel and a printed circuit board connected to the display panel. The second sub-wing may be disposed farther from the printed circuit board than the first sub-wing, and the length of the second sub-wing may be smaller than the length of the first sub-wing.

The third sub-wing may be aligned with a central axis of the body extending in the first direction.

The body may overlap the display panel in a plan view. Each of the cushion pads may further include a second wing that is symmetrical to the first wing with respect to the body, and a third wing that overlaps the printed circuit board in the plan view.

The first wing and the second wing may not overlap the display panel in the plan view. In the first direction, a width of the third sub-wing may be smaller than each of a width of the first sub-wing and a width of the second sub-wing.

The wall may include a first side wall and a second side wall facing each other in the first direction. The first side wall may include a first protrusion, a second protrusion, and a third protrusion, which protrude toward the accommodation space and are aligned in the second direction. The second protrusion may be disposed between the first sub-wing and the second sub-wing and face the third sub-wing in the first direction.

The first sub-wing may be disposed between the first protrusion and the second protrusion, and the second sub-wing may be disposed between the second protrusion and the third protrusion.

The first sub-wing may be spaced apart from an end of the body in the second direction and near the first sub-wing, and the second sub-wing may be spaced apart from another end of the body in the second direction and near the second sub-wing.

According to embodiments, movement of display devices within a packaging tray can be reduced and damage to the display devices can be effectively prevented. Additionally, it is possible to prevent damage to a packaging box from occurring due to contact or friction between the packaging tray and the display devices. Additionally, according to the embodiments there are advantageous effects that can be recognized throughout the specification.

DETAILED DESCRIPTION

Figure 1:
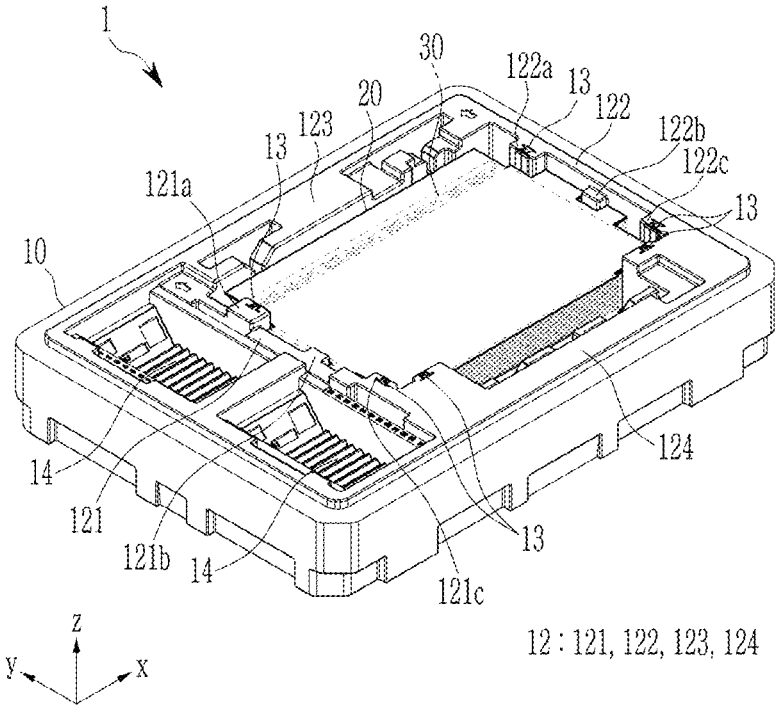
FIG. 1 is a perspective view of a display device packaging assembly according to one embodiment.

With reference to the attached drawings, the embodiments will be described in detail so that those skilled in the art can easily implement.

When a part of a layer, membrane, region, or plate is said to be "above" or "on" another part, this includes not only being "directly on" another component, but also having another component in between. Conversely, when a composition is said to be "right above" another composition, it means that there is no other composition in between.

Throughout the specification, it means that a part may further include other elements, unless there is a statement to the contrary that it does not include another element.

Throughout the specification, "connected" does not mean only the case where two or more components are directly connected, but also when two or more components are indirectly connected through other components, physically connected, or electrically connected. In addition, it may include cases where each part, which is referred to by a different name depending on location or function, but is substantially integrated, is connected to another part.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. Throughout the disclosure, the expression "at least one of a, b or c" indicates only a, only b, only c, both a and b, both a and c, both b and c, all of a, b, and c, or variations thereof. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

In the drawings, the symbols "x", "y", and "z" are used to indicate directions, where "x" is a first direction, "y" is a second direction perpendicular to the first direction, and "z" is a third direction perpendicular to the first and second directions.

Figure 2:
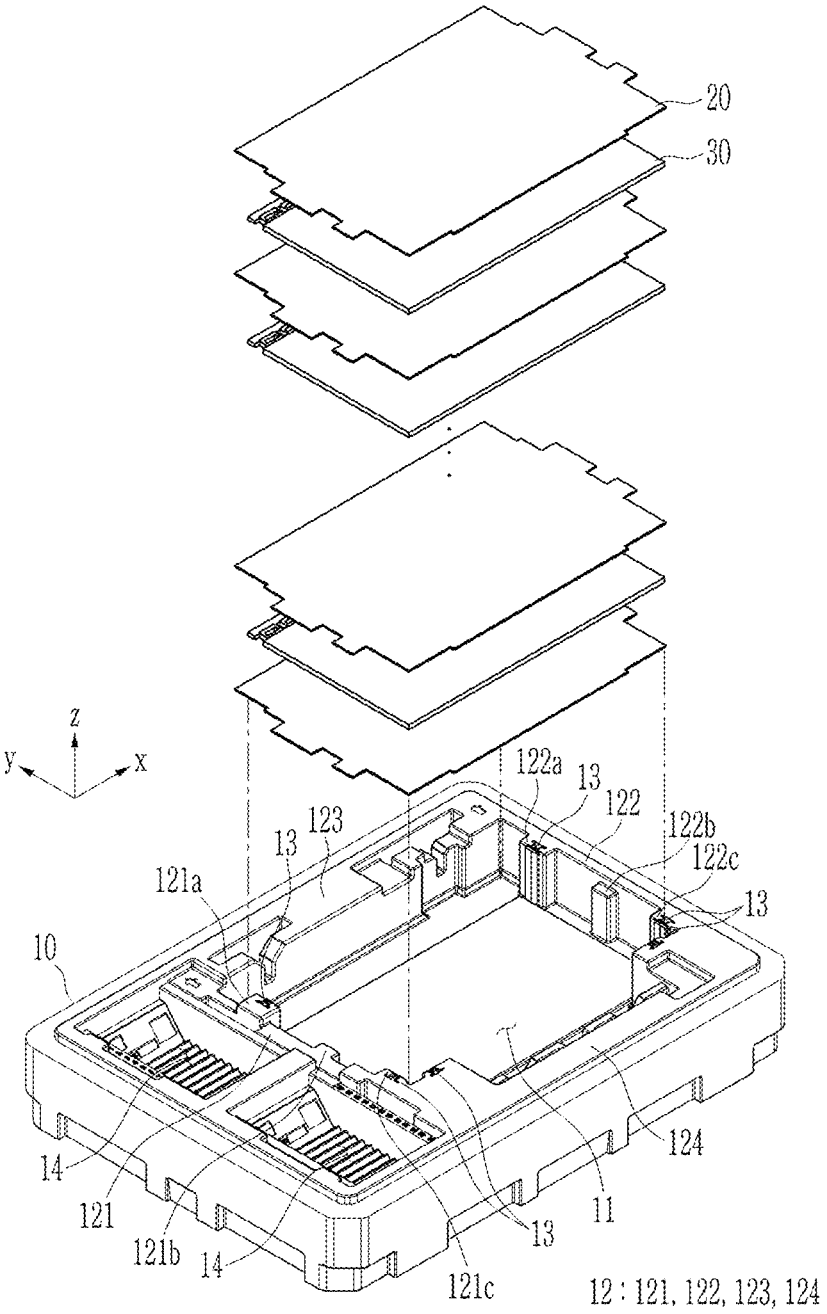
FIG. 2 is an exploded perspective view of a display device packaging assembly according to an embodiment.

FIG. 1 is a perspective view of a display device packaging assembly according to an embodiment, and FIG. 2 is an exploded perspective view of a display device packaging assembly according to an embodiment.

FIG. 1 and FIG. 2, the display device packaging assembly (hereinafter also simply referred to as "packaging assembly") 1 may include a packaging tray 10, and cushion pads 20.

Display devices 30 may be loaded in the packaging tray 10, and cushion pads 20 may be placed between the display devices 30.

The packaging tray 10 may overall have a substantially rectangular parallelepiped shape. The packaging tray 10 may have a width in the first direction x, a depth in the second direction y, and a height in the third direction z.

The packaging tray 10 may be used to load and transport the display device 30. The packaging tray 10 may accommodate the display devices 30 therein and protect the display devices 30 from external environments and impacts. The packaging tray 10 may be made of a foamed resin such as Styrofoam. For example, the packaging tray 10 may be formed by foaming and molding a raw resin in a mold.

The packaging tray 10 may include expanded polystyrene ("EPS"), expanded polypropylene ("EPP"), expanded polyethylene ("EPE"), etc., but is not limited thereto.

The packaging tray 10 may include an accommodation space 11 for accommodating the display devices 30. The accommodation space 11 may be defined by a wall 12 surrounding the accommodation space 11. The wall 12 may include a first side wall 121 and a second side wall 122 facing each other in a first direction x, and a third side wall 123 and a fourth side wall 124 facing each other in a second direction y.

The first side wall 121 may include first, second, and third protrusions 121*a*, 121*b*, and 121*c* that protrude toward the accommodation space 11. The second side wall 122 may include first, second, and third protrusions 122*a*, 122*b*, and 122*c* that protrude toward the accommodation space 11. The bottom surface of the accommodation space 11 may be flat.

The display devices 30 may be loaded in the accommodation space 11 in a lying down state (horizontal state). The display device 30 may be loaded so that the screen on which the image is displayed is approximately parallel to the x-y plane and approximately perpendicular to the x-z plane. A plurality of display devices 30 may be loaded in the packaging tray 10. For example, about 10 or more, about 20 or more, or about 30 or more display devices 30 may be loaded.

The cushion pads 20 may also be located in the accommodation space 11 of the packaging tray 10. The cushion pads 20 and the display devices 30 may be alternately arranged in the third direction z. That is, the cushion pads 20 may be positioned between the display devices 30, and the display device 30 may be positioned between the cushion pads 20. In other words, the cushion pads 20 and the display devices 30 may be alternately arranged in the third direction z. In a structure in which the cushion pads 20 and the display devices 30 are alternately stacked, the cushion pads 20 may be located at the top and bottom. Accordingly, the number of cushion pads 20 may be one more than the number of display devices 30. The cushion pads 20 may have adhesive surfaces and may prevent movement or slippage between the display devices 30. Additionally, the cushion pads 20 may reduce movement or movement of the display devices 30 within the accommodation space 11.

The packaging tray 10 may further include protection pads 13 disposed at the wall 12.

In a plan view, the protection pads 13 may be approximately "H" shaped. As used herein, the "plan view" is a view in a direction (third direction z) in which the cushion pads 20 and the display devices 30 are alternately arranged. A portion of the protection pad 13 may be inserted into the wall 12, and a portion of the protection pad 13 may be exposed to the accommodation space 11. For example, in the "H" shaped protection pad 13, the "T" shaped portion may be inserted into the wall 12, and the remaining "I" shaped portion may be exposed to the accommodation space 11. The protection pad 13 may be formed from plastic materials such as polycarbonate and polyethylene terephthalate, and the surface of the portion exposed to the accommodation space 11 may be coated or attached with a layer made of a cushioned material (for example, urethane). The protection pad 13 may extend from the top of the accommodation space 11 to the bottom surface. When loading the display devices 30 into the accommodation space 11 and after the display devices 30 are loaded into the accommodation space 11, the edges of the display devices 30 may be in contact with the protection pads 13 other than wall 12 and may be supported by the protection pads 13. Accordingly, the wall 12 may be prevented from being damaged by being scratched or pressed by the edges of the display devices 30, and movement of the display devices 30 within the accommodation space 11 in the first direction x and/or the second direction y may be restricted.

The packaging tray 10 may further include an auxiliary accommodation space 14 located at one side of the accommodation space 11. The auxiliary accommodation space 14 may accommodate printed circuit board assemblies ("PBA") (not shown) for driving the display devices 30. The number of printed circuit board assemblies may correspond to the number of display devices 30 loaded in the accommodation space 11.

The display device packaging assembly 1 and the display device 30 loaded therein will be described in more detail with reference to FIGS. 3 to 8 along with FIGS. 1 and 2.

Figure 3:
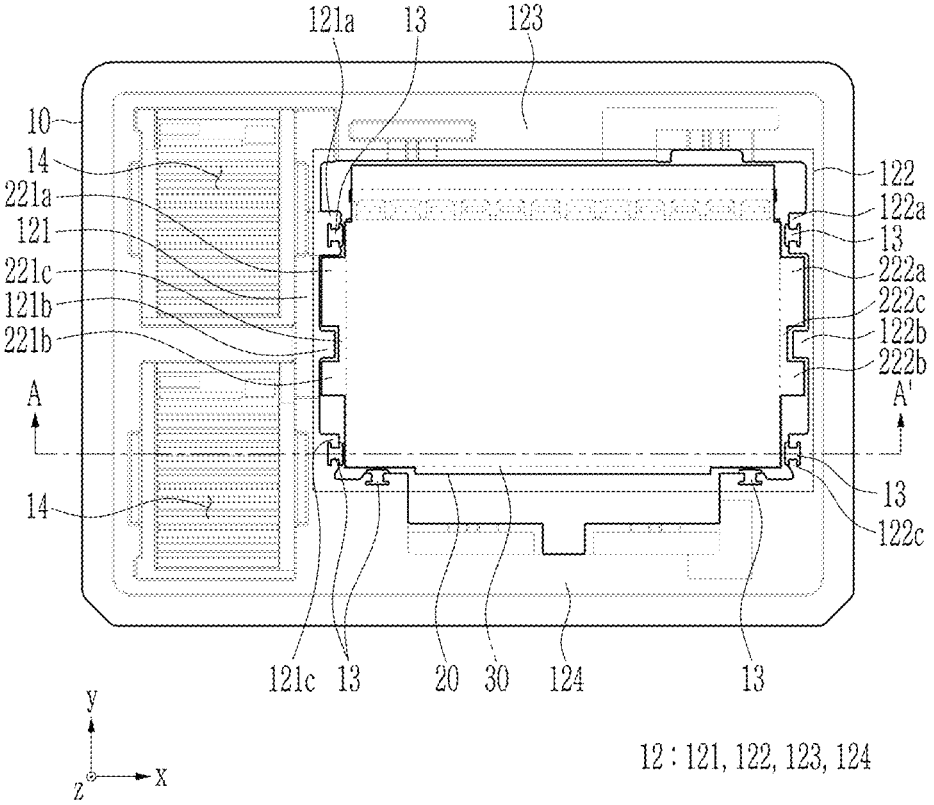
FIG. 3 is a plan view of a display device packaging assembly according to one embodiment.
Figure 4:
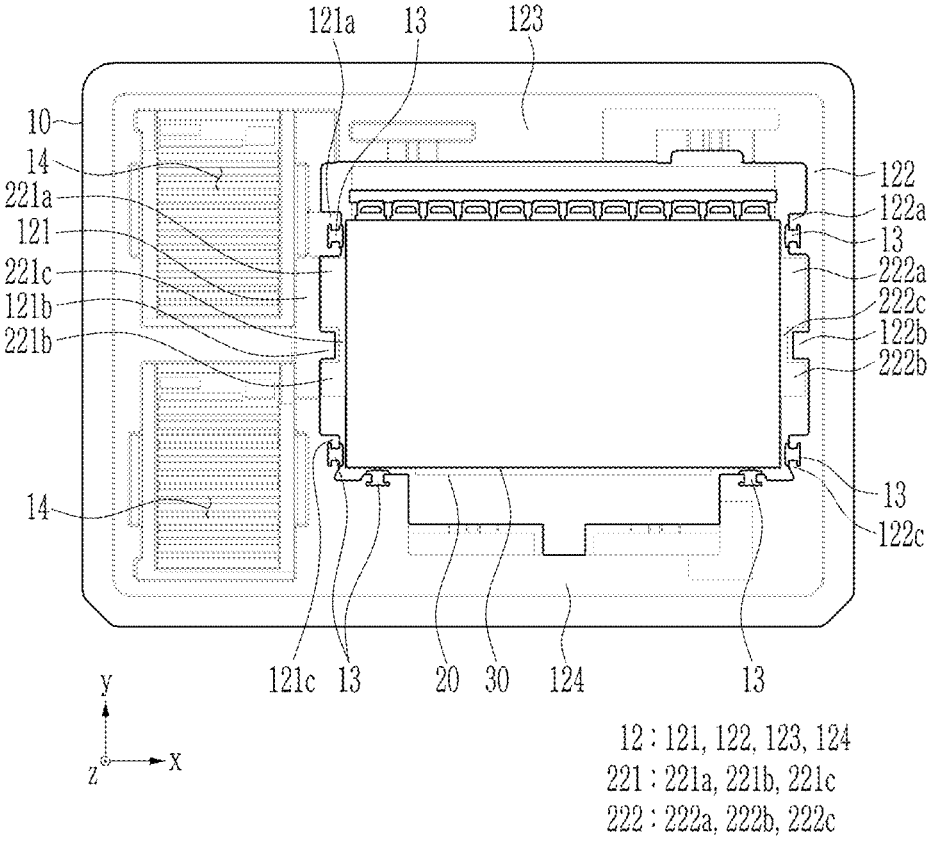
FIG. 4 is a plan view of the display device packaging assembly shown in FIG. 3 with the uppermost cushion pad removed.
Figure 5:
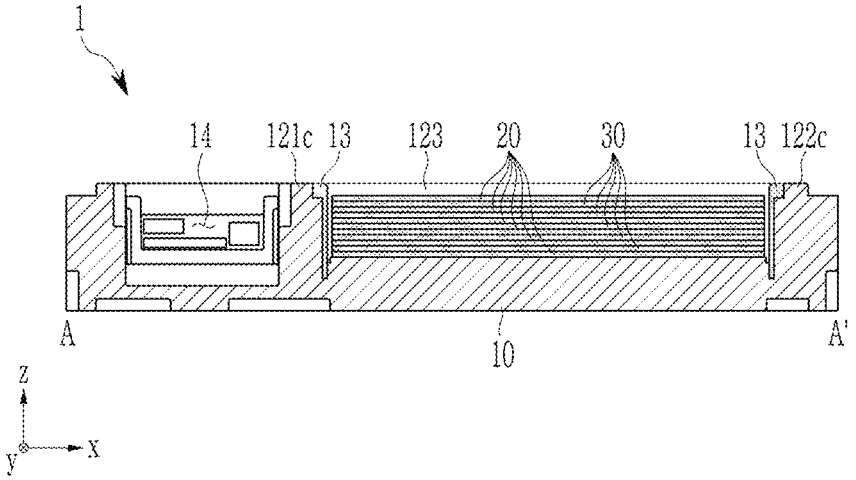
FIG. 5 is a longitudinal cross-sectional view taken along line A-A' in FIG. 3.
Figure 6:
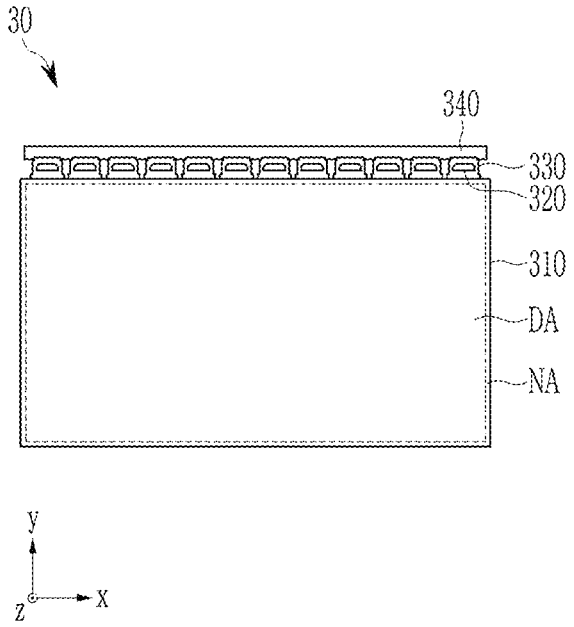
FIG. 6 is a plan view showing one display device separated from the display device packaging assembly shown in FIG. 3.
Figure 7:
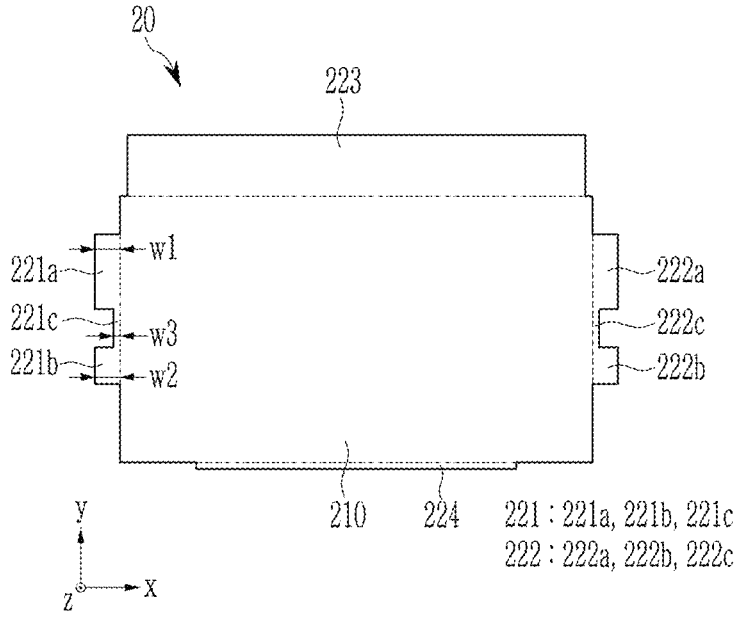
FIG. 7 is a plan view showing one cushion pad separated from the display device packaging assembly shown in FIG. 3.
Figure 8:
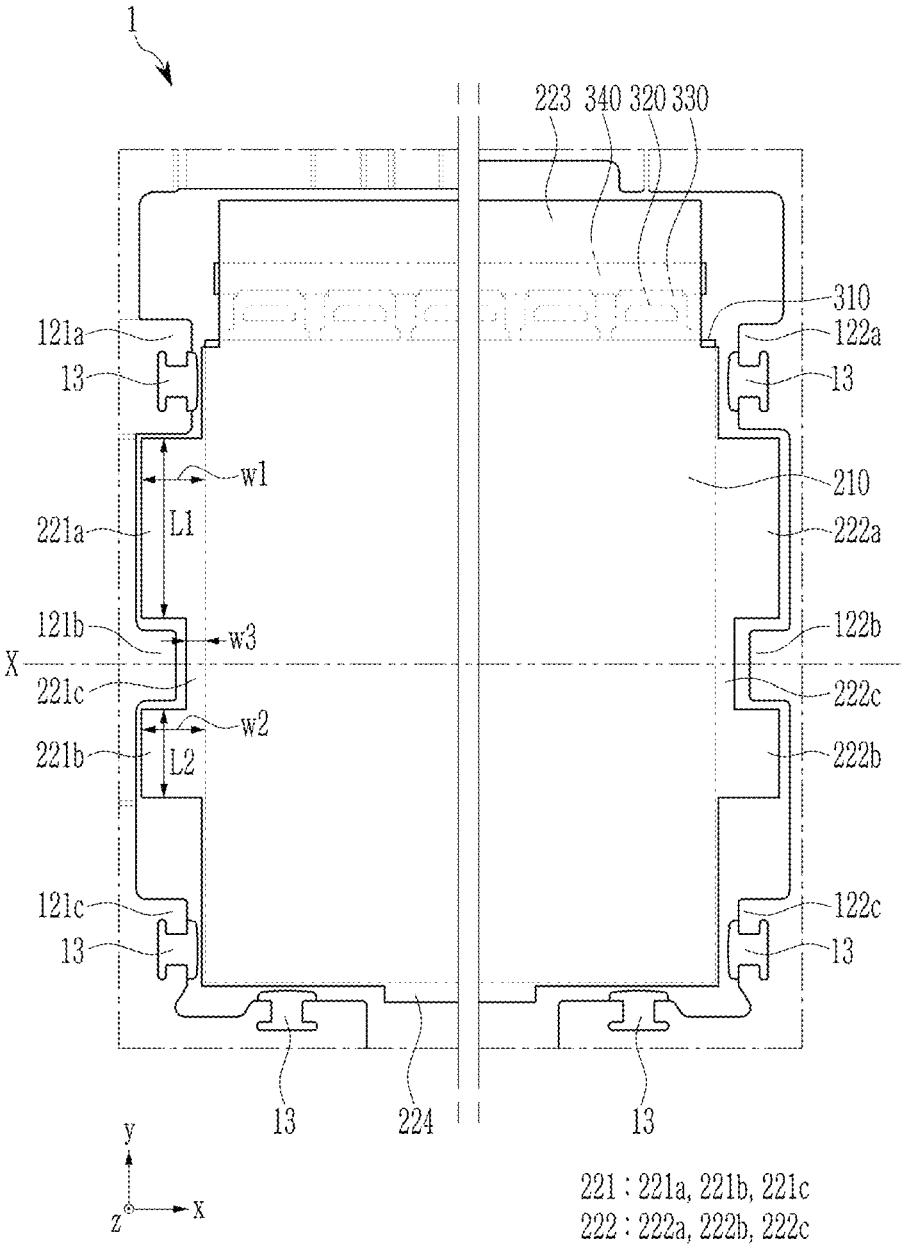
FIG. 8 is a partially enlarged view of the display device packaging assembly shown in FIG. 3.

FIG. 3 is a plan view of a display device package assembly according to an embodiment, FIG. 4 is a plan view of the display device package assembly shown in FIG. 3 with the uppermost sheet removed, and FIG. 5 is a cross-sectional view taken along line A-A' in FIG. 3. FIG. 6 is a plan view showing one display device separated from the display device packaging assembly shown in FIG. 3, and FIG. 7 is a plan view showing one cushion pad separated from the display device packaging assembly shown in FIG. 3. FIG. 8 is a partially enlarged view of the display device packaging assembly shown in FIG. 3. FIG. 8 shows an enlarged view of the vicinity of the left edge and the right edge of the cushion pad 20 in FIG. 3.

As shown in FIG. 1 to FIG. 8, the packaging tray 10 may include an accommodation space 11 defined by the wall 12. In the accommodation space 11, cushion pads 20 and display devices 30 may be stacked alternately. The cushion pad 20 may be a sheet, such as a plastic sheet, and sides of the cushion pad 20 opposite to each other may be adhesive surfaces. By arranging the cushion pads 20 between the display devices 30, relative movement between the display devices 30 may be prevented or suppressed. In addition, since the cushion pad 20 is disposed between the bottom surface of the accommodation space 11 and the bottom display device 30, the bottom display device 30 may be prevented or suppressed from moving on the bottom surface of the accommodation space 11, and the movement of all of the display devices 30, whose relative movement is restricted by the cushion pads 20, may be effectively restricted from moving within the accommodation space 11.

The display devices 30 may be prevented from moving within the accommodation space 11 by the protection pads 13 provided at the first side wall 121, the second side wall 122, and the fourth side wall 124. The display device 30 may include a display panel 310 that displays images and first printed circuit boards 330 connected to the display panel 310. In a plan view, the left and right sides of the display panels 310 may be supported by the protection pads 13 placed on the left and right of the display panels 310 in FIG. 8. As a result, the display may be suppressed from moving in the first direction x. The protection pads 13 may be disposed only on the lower side of the display devices 30 and not on the upper side. This is because, due to the structural characteristics of the display device 30, it may be difficult to install the protection pad 13 that may support the upper side of the display panel 310. Accordingly, only the lower side of the display panels 310 is supported by the protection pads 13, which may not be sufficient to suppress movement of the display devices 30 in the second direction y (i.e., the display devices 30 are movable upward in a plan view). If the display devices 30 move, the display devices 30 may be damaged, and the wall 12 may be ground by the display devices 30 and the display devices 30 may be contaminated. The cushion pad 20 may have a structure for suppressing movement of the display devices 30 in the second direction y in combination with the wall 12, which will be described later.

To describe the display device 30 in more detail with reference to FIG. 6, the display device 30 includes a display panel 310, a driving unit including driving integrated circuit chips 320, a first printed circuit board 330, a second printed circuit board 340, etc. At least a portion of the first printed circuit board 330 may be flexible and bendable. The first printed circuit board 330 may be called a flexible printed circuit board or a printed circuit film.

The display panel 310 may be a light emitting display panel including light emitting diodes, or a liquid crystal display panel including a liquid crystal layer, but is not limited thereto. The display panel 310 may have an overall thin rectangular plate shape and may provide a screen that displays images. The display panel 310 may have a rectangular shape in a plan view, but may have various shapes other than rectangles, such as polygons or circles. The display panel 310 may include a substrate, elements formed thereon, and a protective layer covering the elements. A light emitting display panel may have a circuit layer and light emitting diodes located between two substrates. A liquid crystal display panel may have a circuit layer and a liquid crystal layer located between two substrates. The substrate may be a rigid substrate containing glass. The substrate may be a flexible substrate containing plastic such as polyimide, etc. The display panel 310 includes a display area DA corresponding to a screen on which images are displayed, and a non-display area NA where circuits and/or signal lines for generating and/or transmitting various signals applied to the display area DA are arranged. The non-display area NA may surround the display area DA. In FIG. 6, the inside and outside of the dotted rectangle may correspond to the display area DA and the non-display area NA, respectively.

Pixels may be arranged in a matrix in the display area DA of the display panel 310. Additionally, signal lines such as a gate line, a data line, and a driving voltage line may be disposed in the display area DA. Each pixel may be connected to a gate line, a data line, a driving voltage line, etc., and may receive a gate signal, a data voltage, a driving voltage, etc. from these signal lines. The pixel may be implemented as a light emitting device such as a light emitting diode. Touch electrodes for detecting a user's contact and/or non-contact touch may be disposed in the display area DA. Accordingly, the display panel 310 may be a touch screen panel capable of displaying images and detecting touches. Although the display area DA is shown as being generally rectangular, the display area DA may have various shapes other than a rectangle, such as a polygon, a circle, or an oval.

A driving unit that generates and/or processes various signals for driving the display panel 310 may be located in the non-display area NA of the display panel 310. The driving devices include a data driver that applies a data voltage to the data lines, a gate driver that applies a gate signal to the gate lines, and a signal controller that controls the data driver and the gate driver. The pixels may receive a data voltage at certain timing according to the gate signal generated by the gate driver. The gate driver may be integrated into the display panel 310 and may be located on at least one side of the display area DA (e.g., the left and right sides of the display area DA). The data driver may be provided as a driving integrated circuit chip 320. The driving integrated circuit chip 320 may be mounted on the first printed circuit board 330. The driving integrated circuit chip 320 may be mounted in the non-display area NA at the bottom of the display panel 310. The data driver may be provided as one or more driving integrated circuit chips 320 depending on the size of the display panel 310. In the illustrated embodiment, twelve driving integrated circuit chips 320 are arranged in a row along the first direction x. The signal control unit may be provided as an integrated circuit chip, mounted on the second printed circuit board 340, and electrically connected to the driving integrated circuit chip 320 and the display panel 310 through the first printed circuit board 330.

A pad portion (not shown) in which pads are arranged to receive signals from the outside of the display panel 310 may be located in the non-display area NA of the display panel 310. The pad portion may be located at the bottom of the display panel 310. One end of the first printed circuit board 330 may be bonded to the pad portion. Pads of the first printed circuit boards 330 may be electrically connected to pads of the pad portion.

A signal control unit, a power management integrated circuit ("PMIC"), etc. may be located on the second printed circuit board 340. The other end of the first printed circuit board 330 may be bonded to the second printed circuit board 340.

In an electronic device where the display device 30 is applied, the first printed circuit board 330 may be bent to wrap around the bottom edge of the display panel 310 that is approximately parallel to the first direction x, once it is joined to the pad part. The second printed circuit board 340 may be located on the back of the display panel 310, minimize a portion protruding from the display panel 310, and reduce the planar size of the display device 30. However, when the display device 30 is loaded in the packaging tray 10, the first printed circuit boards 330 may be unfolded without bending as shown so that the thickness of the display device 30 does not increase. Since the first printed circuit board 330 is bonded to the vicinity of the upper corner of the display panel 310, it may be difficult to provide the wall 12 with a protection pad 13 that may support and guide the upper side of the display panel 310, and accordingly, supplementary measures may be desirable to suppress movement of the display device 30 in the second direction y.

To describe the cushion pad 20 in more detail with reference to FIG. 7, the cushion pad 20 may be an adhesive sheet with a predetermined thickness. The cushion pad 20 may have a thickness of, for example, about 1 millimeter (mm) to about 3 mm, and sides opposite to each other may be adhesive. The cushion pad 20 may have a structure in which an adhesive layer is laminated on sides of a central layer opposite to each other. The center layer may be a foam sheet or cushion layer manufactured by non-crosslinked foaming of low density polyethylene ("LDPE"). The adhesive layer located on sides of the center layer opposite to each other may be made of high density polyethylene ("HDPE"), and may be bonded to the upper and lower surfaces of the center layer by heat compression. The materials of the center layer and adhesive layer may be varied. The adhesive layer may be made of a mixture containing high-density polyethylene and an adhesive to provide adhesive strength. As an adhesive, ethylene vinyl acetate ("EVA"), metallocene polyethylene ("m-PE"), etc. may be used. The adhesive layer may further include an antistatic agent to prevent static electricity. Accordingly, the cushion pad 20 may have adhesiveness such that it can be detachably attached to the display device 30.

The cushion pad 20 may include a body 210 and wings 221-224. The body 210 and the wings 221-224 may be formed as one piece. The body 210 may correspond to the display panel 310. For example, the body 210 may be rectangular and may correspond to the area shown by a dotted line in FIG. 7. The body 210 may overlap the display panel 310 within the accommodation space 11 of the packaging tray 10 in a plan view. The wings 221-224 may extend and protrude from the body 210 in predetermined directions.

In a plan view, the wings 221-224 include a first wing 221 located on the left side of the body 210, a second wing 222 located on the right side of the body 210, a third wing 223 located on the upper side of the body 210, and a fourth wing 224 located on the lower side of the body 210 in FIG. 8. The first wing 221 and the second wing 222 may be symmetrical with respect to the body 210. The first to fourth wings 221-224 may not overlap the display panel 310 in a plan view (See FIGS. 8 and 9). The third wing 223 may include a portion that overlaps the first and second printed circuit boards 330 and 340 and a portion that does not overlap the first and second printed circuit boards 330 and 340 in a plan view. In other words, a portion of the third wing 223 that is close to the body 210 may overlap the first and second printed circuit boards 330 and 340, and a portion of the third wing 223 that is far from the body 210 may not overlap the display device 30 in a plan view.

Referring to FIGS. 7 and 8, the first wing 221 may include three sub-wings 221*a*, 221*b*, and 221*c*. The first sub-wing 221*a* may be spaced apart from the upper end of the body 210, the second sub-wing 221*b* may be spaced apart from the lower end of the body 210, and the third sub-wing 221*c* may be located between the first sub-wing 221*a* and the second sub-wing 221*b* in a plan view. Here, the upper end of the body 210 may be the end of the third wing 223 in the second direction y, and the lower end of the body 210 may be an end of the fourth wing 224 opposite to the upper end in the second direction y. The third sub-wing 221*c* may protrude less from the body 210 than the first and second sub-wings 221*a* and 221*b*. In other words, in the first direction x, the width w3 of the third sub-wing 221*c* may be smaller than the width w1 of the first sub-wing 221*a*, and the width w3 of the third sub-wing 221*c* may be smaller than the width w2 of the second sub-wing 221*b*. For example, the width w1 of the first sub-wing 221*a* and the width w2 of the second sub-wing 221*b* may each be about 20 mm or more, or about 25 mm or more, and the width of the third sub-wing 221*c* may be about 10 mm or less, or about 5 mm or less. If the widths w1 and w2 of the first and second sub-wings 221*a* and 221*b* are less than 20 mm or the width of the third sub-wing 22*c* is greater than 10 mm, the engagement between the first to third sub-wings 221*a*, 221*b*, 222*c* and the first to third protrusions 121*a*, 121*b*, and 121*c* may be weakened, thereby reducing the ability to suppress movement of the display devices 30.

The width w1 of the first sub-wing 221*a* and the width w2 of the second sub-wing 221*b* may be the same, but may also be different from each other. The first wing 221 may be divided into two parts by the third sub-wing 221*c*. Similar to the first wing 221, the second wing 222 may include three sub-wings 222*a*, 222*b*, and 222*c*. The first sub-wing 222*a* may be spaced apart from the upper end of the body 210, the second sub-wing 222*b* may be spaced apart from the lower end of the body 210, and the third sub-wing 222*c* may be located between the first sub-wing 222*a* and the second sub-wing 222*b*. The third sub-wing 222*c* may protrude less from the body 210 than the first and second sub-wings 222*a* and 222*b*. The second wing 222 may be divided into two parts by the third sub-wing 222*c*.

The first to third sub-wings 221*a*, 221*b*, and 221*c* of the first wing 221 may engage with the first to third protrusions 121*a*, 121*b*, and 121*c* of the first side wall 121. That is, in a plan view, the first sub-wing 221*a* may be located between the first protrusion 121*a* and the second protrusion 121*b*, the second protrusion 121*b* may be located between the first sub-wing 221*a* and the second sub-wing 221*b* and face the third sub-wing 221*c*, and the second sub-wing 221*b* may be located between the second protrusion 121*b* and the third protrusion 121*c*. In a plan view, the top of the first sub-wing 221*a* and the bottom of the first protrusion 121*a* in the second direction y may contact or be adjacent to each other. In a plan view, the upper end of the second sub-wing 221*b* and the lower end of the second protrusion 121*b* in the second direction y may contact or be adjacent to each other. In a plan view, the lower end of the first sub-wing 221*a* and the upper end of the second protrusion 121*b* may contact or be adjacent to each other. In a plan view, the left end of the third sub-wing 221*c* and the right end of the second protrusion 121*b* may contact or be adjacent to each other in FIG. 8. In the same way as the relationship between the first wing 221 and the first side wall 121, the first to third sub-wings 222*a*, 222*b*, and 222*c* of the second wing 222 may engage with the first to third protrusions 122*a*, 122*b*, and 122*c* of the second side wall 122. In this way, by the interlocking structure of the cushion pads 20 and the packaging tray 10, which is provided by the first and second wings 221 and 222 and the first and second side walls 121 and 122, the movement of the cushion pads 20 in the second direction y may be limited, and also the movement of the display devices 30 attached to the cushion pads 20 in the second direction y may be inhibited. Therefore, even if the packaging tray 10 does not include the protection pad 13 that supports the top of the display panel 310 in the second direction y, when an external impact occurs during transportation of the display device packaging assembly 1, it is possible to effectively prevent the display devices 30 from be pushed, separated, or damaged.

The second protrusions 121*b* and 122*b* and the third sub wings 221*c* and 222*c* may be arranged to be aligned with the central axis X of the display panel 310. Here, alignment may mean that the second protrusions 121*b* and 122*b* and the third sub wings 221*c* and 222*c* are located on the central axis X in a plan view. For example, the central axis X may pass through the centers of the second protrusions 121*b* and 122*b* in the second direction y. The central axis X may correspond to a straight line that evenly divides the display panel 310 vertically, i.e., in the second direction y, and extends in the first direction x. The central axis of the body 210 may correspond to the central axis X of the display panel 310. That is, the central axis X may equally divide the body 210 into two, that is, upper part and lower part. In this way, by disposing the second protrusions 121*b* and 122*b* and the third sub-wings 221*c* and 222*c*, rotation of the display panel 310 may be suppressed.

As described above, the first wing 221 may include a third sub-wing 221*c* having a width w3 that is narrower than the widths w1 and w2 of the first and second sub-wings 221*a* and 221*b*. Additionally, the second wing 222 may include a third sub-wing 222*c* having a width that is narrower than the widths of the first and second sub-wings 222*a* and 222*b*. When an impact is applied to the display device packaging assembly 1 or the display device packaging assembly 1 is shaken and the display devices 30 move in the first direction x, there is a risk that the display panels 310 may come into contact with the second protrusions 121*b* and 122*b* of the side walls 121 and 122. When the display panels 310 and the second protrusions 121*b* and 122*b* come into contact, the second protrusions 121*b* and 122*b* may be broken. This may contaminate the display devices 30 or make reuse of the packaging tray 10 difficult. Contact between the display panels 310 and the second protrusions 121*b* and 122*b* may be prevented by the third sub wings 221*c* and 222*c* which protrude from the body 210 overlapping the display panels 310 in a plan view. Since the third sub-wing 221*c* is located between the display panels 310 and the second protrusion 121*b*, the display panels 310 and the second protrusion 121*b* may be spaced at least by the width w3 of the third sub-wing 221*c*, and also, since the third sub-wing 222*c* is located between the display panels 310 and the second protrusion 122*b*, the display panels 310 and the second protrusion 122*b* may be spaced at least by the width of the third sub-wing 222*c*.

Figure 9:
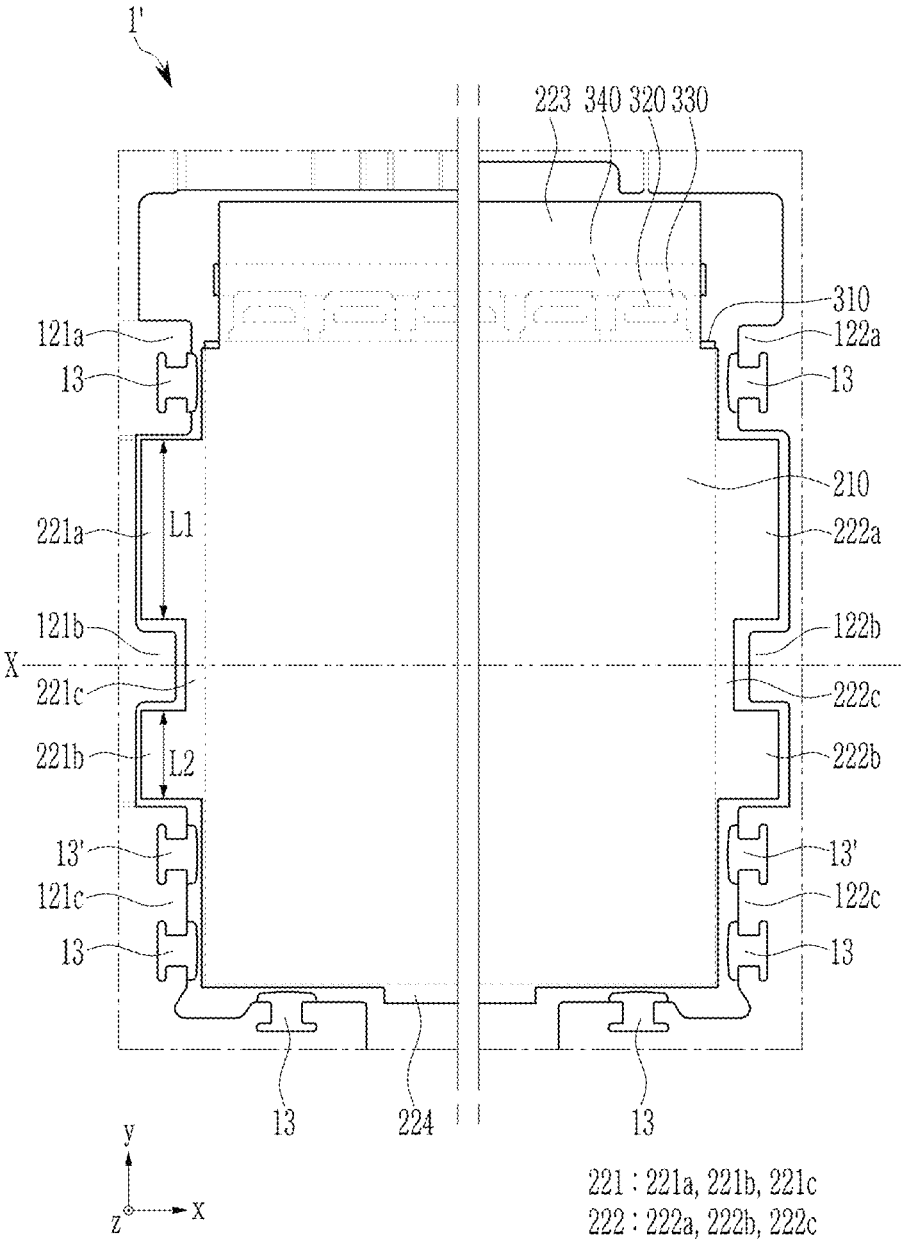
FIG. 9 is a partially enlarged plan view of a display device packaging assembly according to another embodiment.

FIG. 9 is a partially enlarged plan view of a display device packaging assembly according to another embodiment. FIG. 9 may correspond to the area shown in FIG. 8 in a plan view of the display device packaging assembly 1.

The display device packaging assembly 1' shown in FIG. 9 is different from the above-described embodiment in the shape of the packaging tray 10. Compared to the above-described embodiment, the third protrusion 121*c* of the first side wall 121 of the wall 12 may be formed longer in the second direction y, and the third protrusion 121*c* has two protection pads 13 and 13'. The third protrusion 122*c* of the second side wall 122, which may be symmetrical to the first side wall 121, may be formed longer in the second direction y, and the third protrusion 122*c* may also have two protection pads 13 and 13'. When the left and right sides of the display panels 310 are each supported by a single protection pad 13, there is a risk that the display panels 310 may rotate when the impact applied to the display device packaging assembly 1 is large. As in this embodiment, if the packaging tray 10 is configured to support each side of the display panels 310 with a plurality of protection pads 13 and 13', and even when a larger impact is applied, the display panels 310 may be effectively prevented from moving. In order to secure space for deforming the formation of the third protrusion 121*c* and providing the additional protection pad 13', the length L2 of the wing 221*b* may be shorter than the length L1 of the first sub-wing 221*a* of the first wing 221 in the second direction y. Likewise, the length of the second sub-wing 222*b* may be shorter than the length of the first sub-wing 222*a* of the second wing 222. When the second sub-wings 221*b* and 222*b* are formed in this way, if an additional protection pad 13' is needed to prevent rotation of the display panels 310, it is sufficient to slightly modify the inside of the mold for forming the packaging tray 10, and deformation of the cushion pads 20 may be unnecessary.

Figure 10:
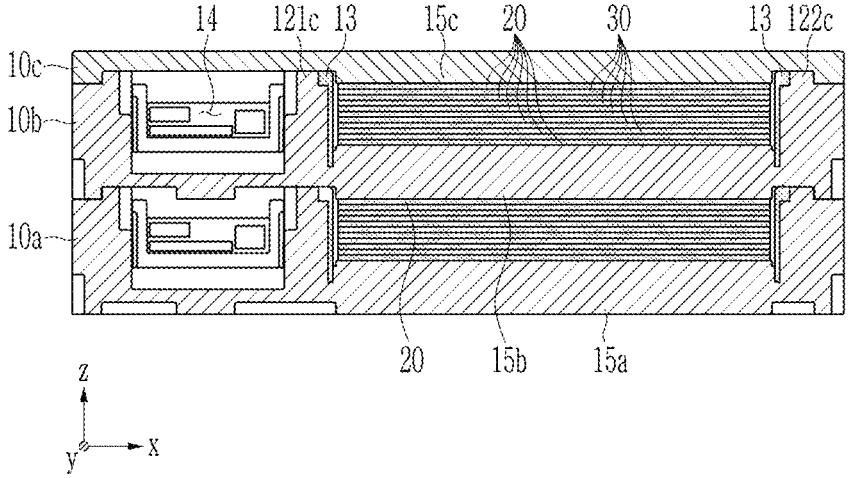
FIG. 10 is a longitudinal cross-sectional view of display device packaging assemblies in an overlapping state according to an embodiment.

FIG. 10 is a longitudinal cross-sectional view of display device packaging assemblies in an overlapping state according to an embodiment.

Referring to FIG. 10, in order to transport a plurality of display device packaging assemblies at once, the display device packaging assemblies may be stacked in the third direction z. That is, a second packaging tray 10*b* containing the display devices 30 and the cushion pads 20 may be placed on a first packaging tray 10*a* containing the display devices 30 and the cushion pads 20. A lid 10*c* instead of another packaging tray may be placed on the second packaging tray 10*b*. Although two-level loading is illustrated in FIG. 10, multiple display device packaging assemblies, such as three-level, four-level, etc., may be loaded and transported in another embodiment. The bottoms of the packaging trays 10*a* and 10*b* may include protrusions 15*a* and 15*b* that project downward, so that the upper packaging assembly (e.g., the second packaging tray 10*b*) can press the cushion pads 20 located in the accommodation space 11 of the lower packaging assembly (e.g., the first packaging tray 10*a*) in a state in which the packaging assemblies are stacked. The cushion pads 20 accommodated in the upper packaging tray (e.g., the second packaging tray 10*b*) may be pressed by the protrusion 15*c* of the lid 10*c*. The protrusions 15*a*, 15*b*, and 15*c* may be formed corresponding to the accommodation spaces 11 of the packaging trays 10*a* and 10*b*. The protrusions 15*a*, 15*b*, and 15*c* may have a shape capable of pressing the first and second wings 221 and 222, as well as the body 210 of the cushion pads 20. Movement of the cushion pads 20 and the display devices 30 attached to the cushion pads 20 may be suppressed by the pressing load of the packaging assembly or the lid 10*c* located on the upper side.

Figure 11:
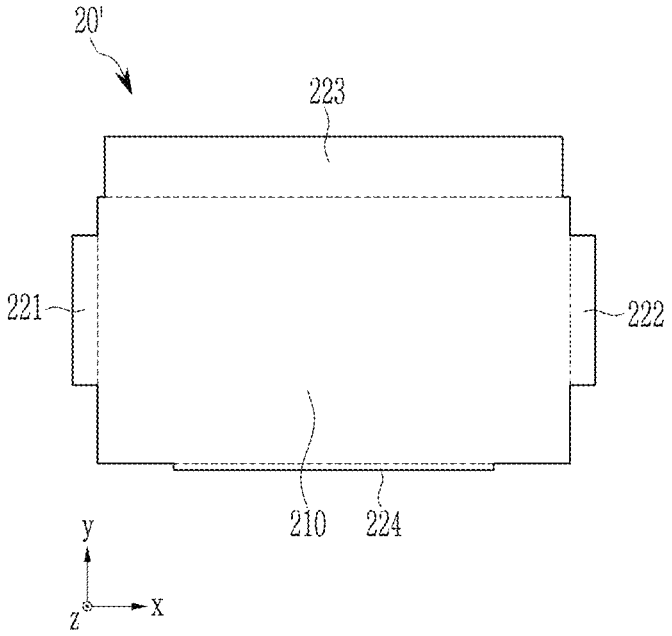
FIG. 11 is a plan view of a cushion pad in a display device packaging assembly according to another embodiment.

FIG. 11 is a plan view of a cushion pad in a display device packaging assembly according to another embodiment.

Referring to FIG. 11, the cushion pad 20' may include a body 210 and wings 221-224 formed integrally with the body 210. The first wing 221 and the second wing 222 may be symmetrical with respect to the body 210. The first and second wings 221 and 222 may be spaced apart from the upper and lower ends of the body 210. Unlike the above-described embodiment, the first and second wings 221 and 222 are not divided into sub-wings and each may have a substantially rectangular shape. When the cushion pad 20' is formed in this way, the first and second side walls 121 and 122 of the packaging tray 10 may not include the second protrusions 121*b* and 122*b* in accordance with the shape of the cushion pad 20'.

The following table 1 represents the amount of overlapping devices in the display device packaging system analyzed by computer aided engineering ("CAE"), in the case of using a cushion pad that does not include the first and second wings (Comparative example), in the case of using a cushion pad 20 that includes the first and second wings 221 and 222 including the first to third sub-wings 221*a*, 221*b*, 221*c*, 222*a*, 222*b*, and 222*c* as shown in FIG. 7 (Embodiment 1), and in the case of using a cushion pad 20' that includes the first and second wings 221 and 222 as shown in FIG. 11 (Embodiment 2). CAE modeling conditions are as follows. Display panel size: 31.5 inches, packaging tray expansion ratio: 25×, display device stacking count: 24 sheets, cushion pad thickness: 1.881 mm, accommodation space depth: 108 mm.

TABLE 1

| | Movement to the left of the display panel | | Movement to the right of the display panel | |
|---|---|---|---|---|
| Comparative example | 30.4 mm | 100% | 15.8 mm | 100% |
| Embodiment 1 | 19.1 mm | 63% | 7.25 mm | 46% |
| Embodiment 2 | 21.9 mm | 72% | 9.6 mm | 61% |

In the case of using a cushion pad including undivided first and second wings (Embodiment 2), the maximum movement of the display panel was reduced to 72% compared to the case of using a cushion pad without first and second wings (Comparative example). In the case where the first and second wings included first to third sub-wings (Embodiment 1), the maximum movement of the display panel was reduced to 63% compared to the Comparative example. In this way, it may be seen that when the pad includes the first and second wings, the movement of the display panel is reduced, and when the first and second wings include sub-wings, the movement of the display panel is further reduced.

Figure 12:
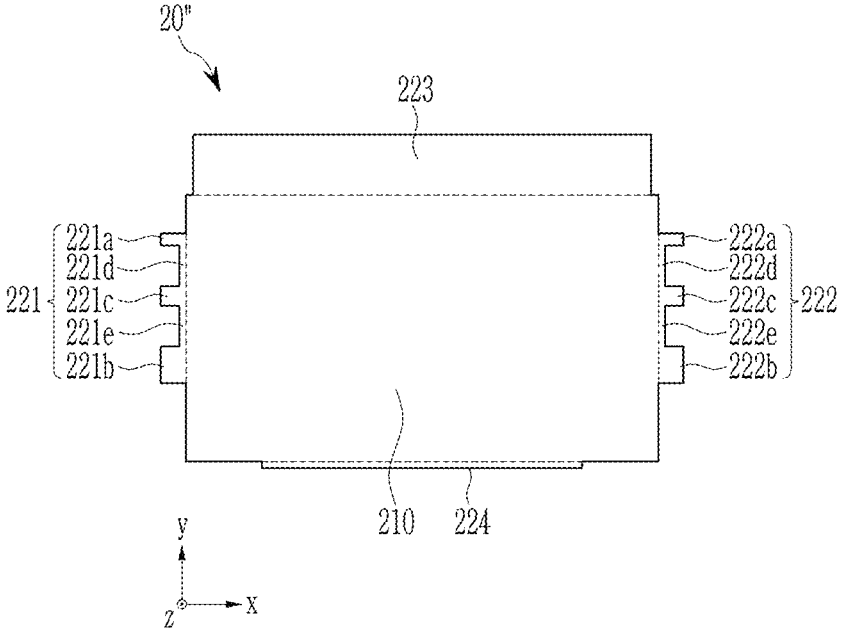
FIG. 12 is a plan view of a cushion pad in a display device packaging assembly according to still another embodiment.

FIG. 12 is a plan view of a cushion pad in a display device packaging assembly according to still another embodiment.

The cushion pad 20" may include a body 210 and wings 221-224 formed integrally with the body 210. The first wing 221 and the second wing 222 may be symmetrical with respect to the body 210. The first wing 221 may include five sub-wings 221*a*-221*e*. The first sub-wing 221*a* may be spaced apart from the upper end of the body 210, the second sub-wing 221*b* may be spaced apart from the lower end of the body 210, and the third sub-wing 221*c* may be located between the sub-wing 221*a* and the second sub-wing 221*b*. The fourth sub-wing 221*d* may be located between the first sub-wing 221*a* and the third sub-wing 221*c*, and the fifth sub-wing 221*e* may be located between the third sub-wing 221*c* and the second sub-wing 221*b*. The fourth and fifth sub-wings 221*d* and 221*e* may protrude less from the body 210 than the first to third sub-wings 221*a*, 221*b*, and 221*c*. That is, in the first direction x, the respective widths of the fourth and fifth sub-wings 221*d* and 221*e* may be smaller than the respective widths of the first to third sub-wings 221*a*, 221*b*, and 221*c*. The first wing 221 may be divided into three parts by the fourth and fifth sub-wings 221*d* and 221*e*. Similar to the first wing 221, the second wing 222 may include five sub-wings 222*a*-222*e*. The second wing 222 may be divided into three parts by the fourth and fifth sub-wings 222*d* and 222*e*.

Although not shown, the first and second side walls 121 and 122 of the packaging tray 10 may include protrusions that may engage with sub-wings 221*a*-221*e* and 222*a*-222*e* of the first and second wings 221 and 222. In this way, the first and second wings 221 and 222 of the cushion pad 20" may include multiple sub-wings 221*a*-221*e* and 222*a*-222*e*, and the wall 12 of the packaging tray 10 may have a corresponding shape, and this may prevent the display devices 30 from moving and being damaged by impacts during transportation of the display device packaging assembly 1. However, compared to the embodiment in which the first and second wings 221 and 222 each include three sub-wings 221*a*-221*c* and 222*a*-222*c*, the size of each sub-wing 221*a*-221*e* and 222*a*-222*e* is small, which may degrade the structural function of the sub-wings 221*a*-221*e* and 222*a*-222*e*, and during automatic packaging in the facility, the sub-wings 221*a*-221*e* and 222*a*-222*e* may fly away, raising concerns that the sub-wings 221*a*-221*e* and 222*a*-222*e* may fold.

Although the embodiments have been described in detail above, the scope of the invention is not limited thereto, and various modifications and improvements made by those skilled in the art using the basic concepts defined in the following claims are also possible.

What is claimed is:

1. A display device packaging assembly, comprising:

a packaging tray including a wall defining an accommodation space; and cushion pads disposed between and on display devices loaded in the accommodation space, wherein each of the cushion pads includes a body and a first wing disposed on one side of the body, the first wing includes a first sub-wing, a second sub-wing, and a third sub-wing disposed between the first sub-wing and the second sub-wing, in a first direction, a width of the third sub-wing is smaller than each of a width of the first sub-wing and a width of the second sub-wing, and a length of the second sub-wing is smaller than a length of the first sub-wing in a second direction intersecting the first direction.

2. The display device packaging assembly of claim 1, wherein the third sub-wing is aligned with a central axis of the body extending in the first direction.

3. The display device packaging assembly of claim 1, wherein the first sub-wing is spaced apart from a first end of the body in a second direction intersecting the first direction and is disposed between the first end of the body and the third sub-wing, and the second sub-wing is spaced apart from a second end of the body opposite the first end of the body in the second direction, and is disposed between the second end of the body and the third sub-wing.

4. The display device packaging assembly of claim 1, wherein each of the cushion pads further includes a second wing symmetrical to the first wing with respect to the body.

5. The display device packaging assembly of claim 4, wherein each of the display devices includes a display panel and a printed circuit board connected to the display panel, the body overlaps the display panel in a plan view, and each of the cushion pads further includes a third wing overlapping the printed circuit board in the plan view.

6. The display device packaging assembly of claim 5, wherein the first wing and the second wing extend from the body in the first direction, and the third wing extends from the body in a second direction intersecting the first direction.

7. The display device packaging assembly of claim 1, wherein the display device packaging assembly is provided in plurality, and a bottom of each of the packaging trays includes a protrusion that protrudes downward such that the package tray of an upper display device packaging assembly among the plurality of display device packaging assemblies presses against the cushion pads in the accommodation space of a lower display device packaging system among the plurality of display device packaging assemblies.

8. The display device packaging assembly of claim 1, wherein sides of each of the cushion pads opposite to each other are adhesive.

9. A display device packaging assembly comprising:

a packaging tray including a wall defining an accommodation space; and cushion pads disposed between and on display devices loaded in the accommodation space, wherein each of the cushion pads includes a body and a first wing disposed on one side of the body, the first wing includes a first sub-wing, a second sub-wing, and a third sub-wing disposed between the first sub-wing and the second sub-wing, in a first direction, a width of the third sub-wing is smaller than each of a width of the first sub-wing and a width of the second sub-wing, and wherein the wall includes a first side wall and a second side wall facing each other in the first direction, the first side wall includes a first protrusion, a second protrusion, and a third protrusion, which protrude toward the accommodation space and are aligned in a second direction intersecting the first direction, and the second protrusion is disposed between the first sub-wing and the second sub-wing and faces the third sub-wing in the first direction.

10. The display device packaging assembly of claim 9, wherein the first sub-wing is disposed between the first protrusion and the second protrusion, and the second sub-wing is disposed between the second protrusion and the third protrusion.

11. A display device packaging assembly, comprising:

a packaging tray including a wall defining an accommodation space;

display devices loaded in the accommodation space; and cushion pads at least some of which are disposed between the display devices, wherein each of the cushion pads includes a body and a first wing extending from the body in a first direction, the first wing includes a first sub-wing, a second sub-wing, and a third sub-wing disposed between the first sub-wing and the second sub-wing in a second direction intersecting the first direction, a length of the first sub-wing and a length of the second sub-wing in the second direction are different from each other, the wall includes a first side wall and a second side wall facing each other in the first direction, the first side wall includes a first protrusion, a second protrusion, and a third protrusion, which protrude toward the accommodation space and are aligned in the second direction, and the second protrusion is disposed between the first sub-wing and the second sub-wing and faces the third sub-wing in the first direction.

12. The display device packaging assembly of claim 11, wherein each of the display devices includes a display panel and a printed circuit board connected to the display panel, the second sub-wing is disposed farther from the printed circuit board than the first sub-wing, and the length of the second sub-wing is smaller than the length of the first sub-wing.

13. The display device packaging assembly of claim 12, wherein the third sub-wing is aligned with a central axis of the body extending in the first direction.

14. The display device packaging assembly of claim 12, wherein the body overlaps the display panel in a plan view, and each of the cushion pads further includes a second wing symmetrical to the first wing with respect to the body and a third wing overlapping the printed circuit board in the plan view.

15. The display device packaging assembly of claim 12, wherein the first wing and the second wing do not overlap the display panel in a plan view.

16. The display device packaging assembly of claim 11, wherein in the first direction, a width of the third sub-wing is smaller than each of a width of the first sub-wing and a width of the second sub-wing.

17. The display device packaging assembly of claim 11, wherein the first sub-wing is disposed between the first protrusion and the second protrusion, and the second sub-wing is disposed between the second protrusion and the third protrusion.

18. The display device packaging assembly of claim 11, wherein the first sub-wing is spaced apart from a first end of the body in the second direction and is disposed between the first end of the body and the third sub-wing, and the second sub-wing is spaced apart from a second end of the body opposite the first end of the body in the second direction and is disposed between the second end of the body and the third sub-wing.

* * * * *